US005816029A

United States Patent [19]

Sweeny

[11] Patent Number: 5,816,029

[45] Date of Patent: Oct. 6, 1998

[54] ANTI-ROTATION DEVICE FOR CAPPING MACHINE

[75] Inventor: Kevin M. Sweeny, Columbia Station, Ohio

[73] Assignee: FCI, Inc., Cleveland, Ohio

[21] Appl. No.: 846,238

[22] Filed: Apr. 28, 1997

[51] Int. Cl.[6] ..... B65B 7/28; B67B 3/20

[52] U.S. Cl. ..... 53/490; 53/317; 53/331.5; 53/367

[58] Field of Search ..... 53/490, 331.5, 53/317, 367, 281, 282, 368, 369, 300

[56] References Cited

U.S. PATENT DOCUMENTS

| | | | |
|---|---|---|---|
| 3,771,284 | 11/1973 | Boeckmann et al. | 53/331.5 X |
| 3,805,488 | 4/1974 | Holstein | 53/331.5 X |
| 4,098,059 | 7/1978 | Chattillion | 53/367 X |
| 4,663,913 | 5/1987 | Trendel | 53/331.5 X |
| 4,939,890 | 7/1990 | Peronek . | |
| 5,398,485 | 3/1995 | Osifchin | 53/490 |
| 5,408,801 | 4/1995 | Molinaro | 53/331.5 X |
| 5,457,936 | 10/1995 | Neel | 53/317 |

OTHER PUBLICATIONS

Print of 2 Pages from cite http:/www.amcoprod.com/petabo.htr "Amco PetaDrive" dated Apr. 12, 1997.

*Primary Examiner*—Horace M. Culver
*Attorney, Agent, or Firm*—Vickers, Daniels & Young

[57] ABSTRACT

A device and method of preventing rotation of a plastic container of the type having a generally cylindrical body, a circular flange below a threaded neck and a pedaloid base with pads separated by diverging recesses as a capping head screws a cap onto the neck while the capping head and container are moving in unison along a preselected path, which device method comprises a support member with an upwardly extending, fixed rib extending along the path whereby the container slides along the rib as it is moved with the capping head so the rib extends into a recess of the pedaloid base to prevent rotation of the container with the capping head.

22 Claims, 6 Drawing Sheets

ANTI-ROTATION DEVICE FOR CAPPING MACHINE

The present invention relates to the art of capping plastic bottles or containers as they are moved along a preselected path and more particularly to an improvement in a capping machine which prevents rotation of the plastic bottle while a cap is being tightened onto the neck of the bottle.

The invention is particularly applicable to assembly of a plastic cap onto a plastic bottle of the type having a pedaloid base constituting a plurality of protruding pads separated by diverging recesses or crevices. However the invention has much broader applications and can be used in applying a cap onto a bottle which has various protrusions on its base.

INCORPORATION BY REFERENCE

Peronek U.S. Pat. No. 4,939,890 describes a capping machine of the type to which the present invention is directed, together with a description of several arrangements used in the art for preventing rotation of the bottle as it is being capped during its rotary movement by a star wheel. This patent is incorporated by reference herein as background information to explain the prior anti-rotation arrangements of which the present invention is a specific improvement. Consequently, the details of the capping machine of the type to which the present invention is directed need not be explained.

BACKGROUND OF INVENTION

A capping machine or conventional capping apparatus includes a star wheel rotatable about a machine axis and having a plurality of outwardly opening pockets adapted to receive bottles fed in an assembly line fashion to the star wheel. Overlying the rotating star wheel is a plurality of individual capper heads for use in applying a cap to the upper threaded neck of a plastic bottle carried by the star wheel in an arcuate path centered about the machine axis. A turret rotates the star wheel and capping heads in synchronism about the machine axis with an individual capping head located directly above each bottle receiving pocket on the star wheel. The capper heads employ a clutch mechanism whereby the head carrying a cap is rotated and driven axially downwardly at a predetermined force and torque limiting value to tighten the cap onto the bottle neck. In accordance with standard practice, an entrant guide mechanism is mated with the capper star wheel to feed filled bottles to an entry point on the path of movement of the capper star wheel. An exit guide mechanism is similarly mated to the capper star wheel to transfer the capped bottles from an exit point of the rotating capper star wheel. A stationary rear guide plate extends generally between the entry and exit points on the capping machine and is spaced radially outwardly from the pockets of the star wheel and functions to retain the bottles in the pockets as the star wheel rotates in unison with the capping heads. This is a conventional capping machine employed in bottling plants and is the mechanism to which the present invention is directed.

During the capping operation, it is necessary to assure that the bottle does not spin as the cap is tightened. A spinning action during the capping procedure can cause damage to the plastic container and reduce the desired tightness of the cap being applied automatically to the bottle as it is translated in a path determined by the star wheel. In the past, certain cap designs required a relatively high downward force during the capping operation. When this occurs, spinning of the bottle is prevented by frictional contact with the pocket, with the rear guide plate or with both of these structures. As the downward force during the capping operation has been reduced due to the design and functional characteristics of the cap being applied, friction at the neck of the bottles has been increased either by the use of upwardly directed knife ridges provided in the anti-spin segment on the top of the individual star wheel pockets. This structure is disclosed in Peronek U.S. Pat. No. 4,939,890. The knife ridges on the anti-spin segment on each pocket engage the lower surface of a circular flange at the bottom of the threaded neck of a plastic bottle to prevent rotation of the plastic bottle. This type of mechanism was not as effective as the downward force used in the capping operation was decreased due to the changes in design of the cap being applied. For that reason, the anti-rotation or anti-spin device of Peronek U.S. Pat. No. 4,939,890 has become the standard in the trade to prevent rotation of plastic bottles as they are being capped with relatively low downward force. This patent teaches a mechanism for externally applying a downward force on the body of a bottle being capped, which force is independent of the downward force created by the capping operation. This anti-spin or anti-rotation mechanism has been successful; however, it requires a mechanism for exerting a downward force on the bottle which is expensive and is dependent upon certain structural characteristics at the upper portion of the bottle itself. Changes in bottle configuration often require a new force exerting mechanism.

The anti-rotation device of Peronek U.S. Pat. No. 4,939,890 is the most successful arrangement for applying plastic threaded safety caps onto the top of plastic bottles where the caps do not require heat to set or position the lower lock band around the neck of the bottle. The lock band of the cap simply snaps into a locking position when the capping head threads the cap onto the upper threaded neck of the plastic bottle. In this type of capping operation, the capper head exerts a downward force of between 15–20 pounds. This low axial force makes retention of the bottle from rotation within the star wheel pocket very difficult. This situation motivated the development and use of the anti-rotation feature disclosed and claimed in Peronek U.S. Pat. No. 4,939,890. The present invention relates to an anti-rotation mechanism to be used on a capping machine, which accomplishes the results of the Peronek anti-rotation arrangement, but does not rely upon developing downward frictional force on the top of the bottle during the capping operation.

THE INVENTION

In accordance with the present invention, there is provided a device or method for preventing rotation of a plastic container, or bottle, of the type having a generally cylindrical body with a circular flange below a threaded neck on the top of the bottle. The invention is particularly applicable for use with a plastic bottle having a pedaloid base which is somewhat standard in the soft drink industry. These bases include a plurality of downwardly extending pads, generally four or five pads, separated by diverging recesses. In the past, plastic bottles with pedaloid bases have been capped in a standard machine with a lower plate having a contoured recess or nest directly aligned with the capping head and pocket of the star wheel. In this arrangement, a plurality of contoured recesses matching the pedaloid base configuration are used to receive the bases of the bottles as the bottles are rotated by the star wheel. Since the bottles rest upon the lower circular plate and are held within a contoured nest on the plate, rotation of the bottles is prevented by an interference between the lower plate and the bottom or base of the bottle. This arrangement is completely different from the concept of increasing the friction at the top of the bottle or otherwise preventing rotation of the bottle by frictional force. Such structure is now being sold by AMCO Products Company under the trademark Peta Drive. The circular plate of this system includes a plurality of upwardly facing recesses, each matching the lower pedaloid base of the bottles. The bottles rest on the lower plate as it rotates with the star wheel. Physical interference prevents rotation of the individual bottles. Provision of a lower circular plate with machined recesses, each matching the contour of a pedaloid base of the plastic bottles is quite expensive. Each of the contoured recesses must be specially produced and accurately matched with respect to the pedaloid base of the bottle being processed. Consequently, each bottle required its own lower support plate. Indeed, when the filled bottles being capped are changed from a four pad pedaloid base to a five pad pedaloid base, a completely new plate for supporting the pedaloid bases must be assembled onto the machine. This arrangement for providing a plate rotatable with the star wheel for supporting the lower pedaloid bases of the bottles demands a plate which must be accurately machined for use with specific star wheels. This is another disadvantage of the use of a solid rotating plate with individual nesting recesses contoured for specific pedaloid base configurations.

In accordance with the present invention, the device or method for preventing rotation of a plastic container of the type having a pedaloid base employs the use of a lower, fixed support member in the form of an upwardly extending arcuate rib matching the path taken by the moving bottles during the capping operation in a capping machine. An arrangement is used for mounting the support member in a position where the container slides along the rib itself as the container is moved around the arcuate path dictated by the movement of capping head and the star wheel. The rib extends into the lower recess of the pedaloid base of the individual bottle to prevent rotation of the bottle or container as the capping head drives the cap onto the upper threaded neck of the bottle. By using this construction, a lower support plate carrying the upstanding rib is fixed and does not rotate with the star wheel. The upwardly extending rib prevents rotation of the bottles during the capping operation. This use of a fixed rib constitutes a drastic improvement over other arrangements for using a lower plate to provide interference against rotation of the bottle by the capping head. These prior devices where movable with the star wheel to provide individual nests matching the bottom contour of the pedaloid bottles being capped in a standard capping machine.

In accordance with another aspect of the present invention there is provided an improvement in a capping machine for applying a threaded cap onto the threaded neck of a plastic container having a generally cylindrical body, a circular flange below the threaded neck and pedaloid base with a plurality of pads separated by diverging recesses. The inventive improvement includes a turret rotatable about a machine axis and carrying a plurality of capping heads, each of which rotates a cap about a capping axis to apply a cap to the neck of a bottle as the capping head and container move in unison about the capping machine axis. A capper star wheel is rotated by the turret about the machine axis and has a plurality of arcuate nesting pockets engaging the plastic containers immediately below the circular flanges and a lower stabilizer with arcuate recesses engaging the container at its body portion. This type of capping machine includes a fixed guide plate with an arcuate guide surface concentric with the machine axis and radially spaced from the star wheel at a position generally diametrically opposite the nesting pocket of the star wheel. Consequently, containers carried by the star wheel are capped as they are moved along the guide surface of the fixed guide plate. The inventive improvement of the present invention is the provision of a container support member fixedly mounted on the machine below the guide plate and below the star wheel. This support member has an upwardly extending arcuate rib with a center of curvature at the machine axis and axially aligned in a vertical direction with the capping axis of the capping heads as the heads are moved in unison with the bottles or containers. Means are provided for locating the support member with the rib extending upwardly into a recess of the pedaloid base of the various containers as they slide along the rib by action of the star wheel as it rotates about the machine axis. In this manner, the arcuately configured rib is fixed below the fixed guide plate. The present improvement is merely a fixed rib onto which the bottles slides during the capping operation. The downward force by the capping operation can be exerted on the rib itself or on the surface carrying the rib.

In accordance with another aspect of the present invention, the rib is provided in an arcuate plate assembled onto the support posts used to mount the guide plate of the capping machine. The plate carrying the rib is moved in a vertical direction so that the bottles moving during the capping operation slide on the plate, on the rib or on both the plate and the rib. The rib extends into the recess on the pedaloid base of the bottle to prevent rotation whether the bottle is resting on the rib or on the support plate carrying the rib. Of course, the rib could be intermittent or continuous and the rib could have a variety of constructions and/or cross sectional configurations. In practice, the rib has a cross section with arcuate edges and a flat top. In accordance with an aspect of the invention, the fixed arcuate plate and the rib aligned with the path of movement of the capping heads are formed from a single piece of metal, such as aluminum, that is milled to remove metal to a depth of about ⅛ inch, thus leaving the rib with a height of approximately ⅛ inch. This procedure has been found to be advantageous in the production of a relatively small arcuately extending rib on the top of a support plate to be mounted under the fixed back guide plate of a capping machine.

The primary object of the present invention is the provision of an anti-rotation or an anti-spin device and method for use in a standard capping machine, which device and method prevent rotation of plastic bottles being capped by engaging a structural characteristic on the bottom of the bottle as it moves through the capping machine.

Another object of the present invention is the provision of a device and method, as defined above, which device and method utilizes a member which is fixed and does not rotate with the star wheel of the capping machine.

Still a further object of the present invention is the provision of a device and method, as defined above, which device and method can accommodate a variety of plastic bottles having pedaloid bases without requiring tailored mechanical structures especially made for different plastic bottles.

Still another object of the present invention is the provision of a device and method, as defined above, which device and method includes a single arcuate rib fixed with respect to the fixed guide plate of a capping machine, which rib engages a mechanical feature of a bottle to prevent rotation of the plastic bottle during the standard capping operation without reliance on friction forces and/or downward capping forces exerted by the capping operation.

These and other objects and advantages will become from the following description taken together with the accompanying drawings which are hereafter described.

PREFERRED EMBODIMENT

Figure 1:
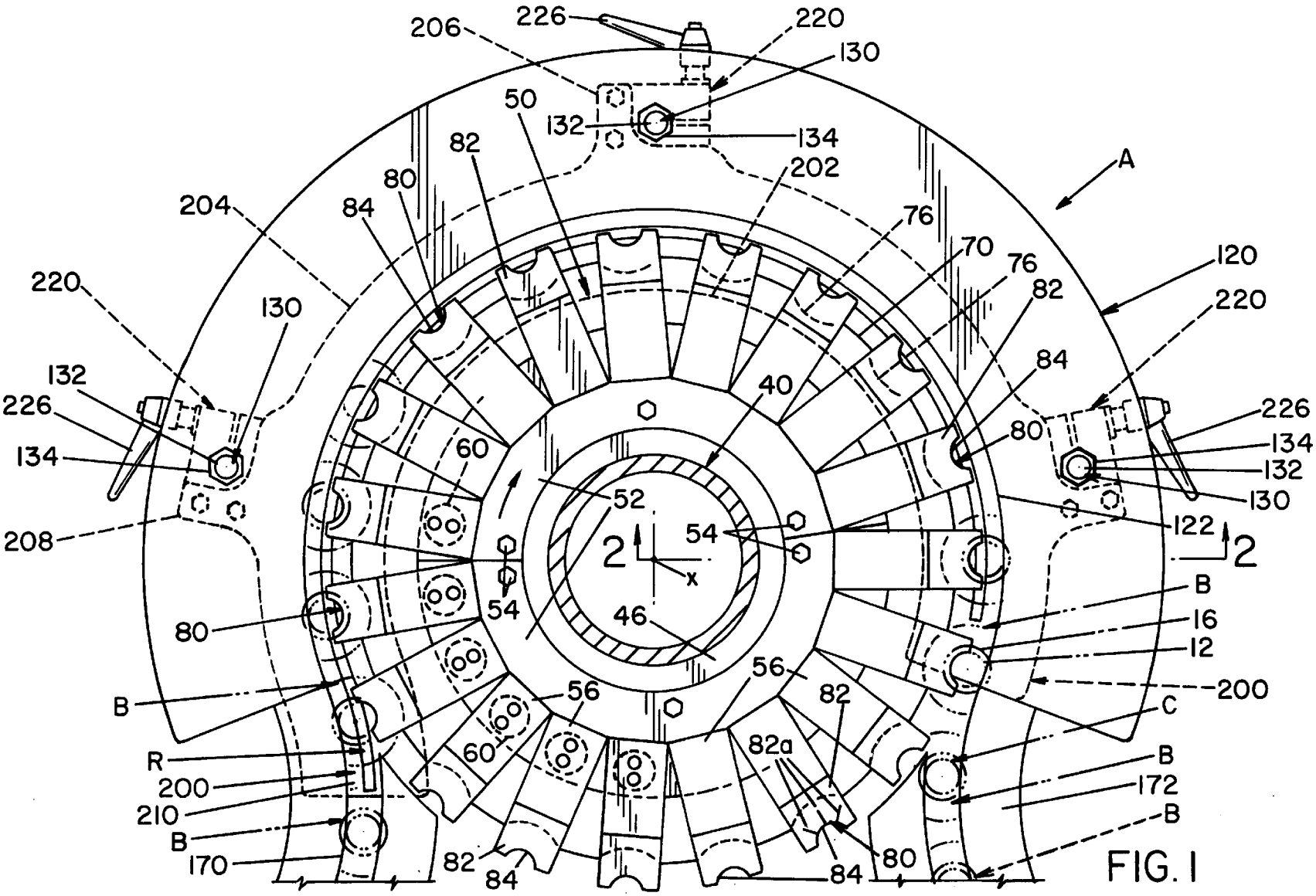
FIG. 1 is a top plan view of a standard bottle capping machine employing the preferred embodiment of the present invention.
Figure 2:
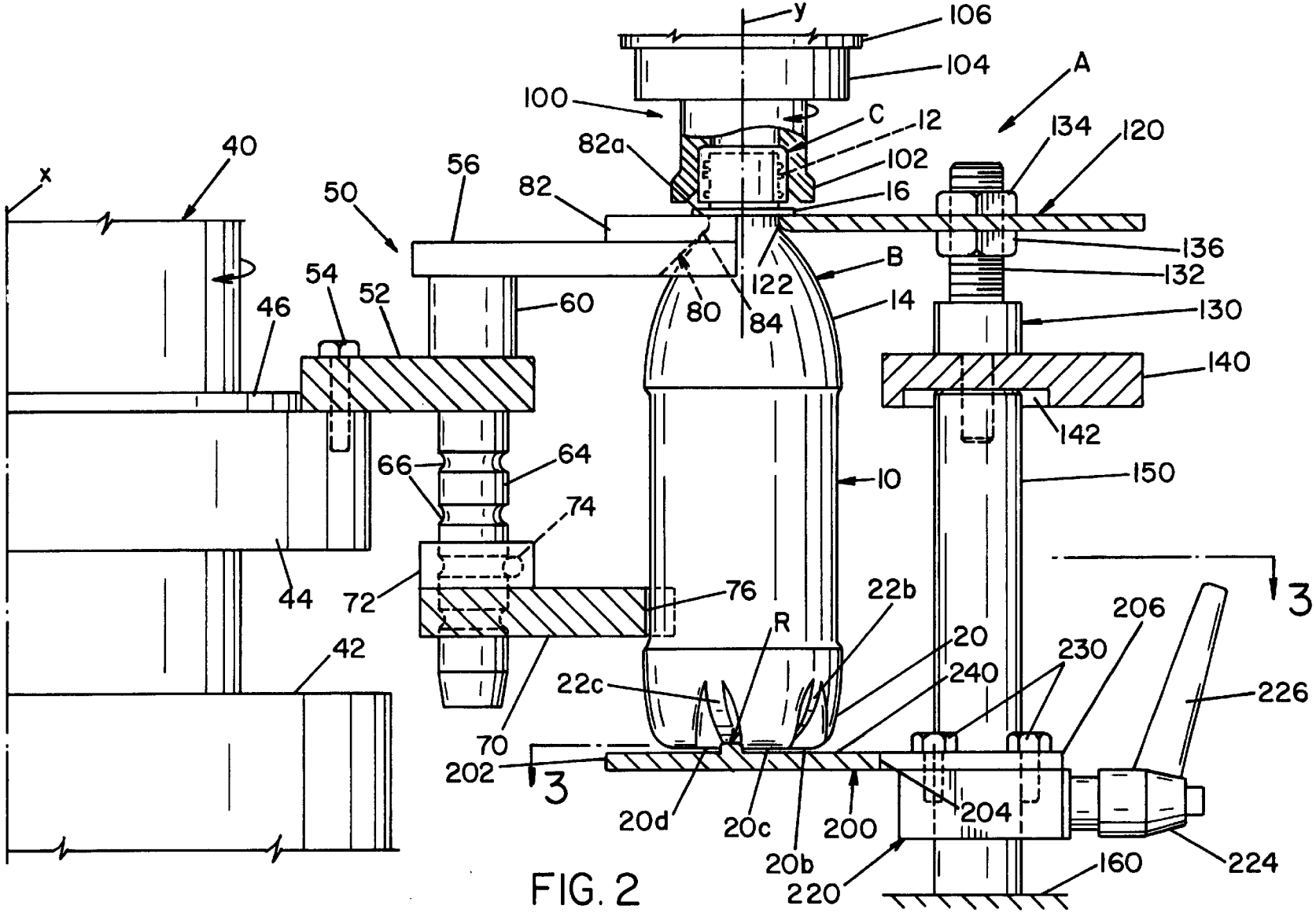
FIG. 2 is an enlarged cross sectional view taken generally along line 2—2 of FIG. 1.

Referring now to the drawings wherein the showings are for the purpose of illustrating a preferred embodiment of the invention only and not for the purpose of limiting same, FIGS. 1 and 2 illustrate a somewhat standard capping machine A of the type used in capping a plastic PET bottle B having various sizes and lengths. In accordance with the illustrated embodiment, bottle or container B includes a generally cylindrical body 10 having an upper threaded neck 12 connected to the body by diverging top portion 14 and provided with a circular flange 16. The base of container or bottle B is a pedaloid base 20 which is quite common in the plastic container industry for use with soft drinks and bottled beverages. A pedaloid base is a base with a number of distinct downwardly extending pads with flat surfaces divided by generally diverging recesses. In the illustrated embodiment pedaloid base 20 includes five pads 20*a*–20*e* separated by five diverging recesses 22*a*–22*e* best shown in FIGS. 6 and 7. Each pad has a generally lower flat support surface. This type of bottom structure gives rigidity and stability to a relatively thin bottle B formed by a standard plastic blow molding process. Onto the upper neck 12 machine A applies a plastic threaded cap C in accordance with standard procedure.

Capping machine A includes a central turret 40 rotatable about machine axis x and supported on lower base 42. In the illustration, turret 40 includes a shoulder 44 and a centering extension 46 for receiving standard star wheel 50 supported by a two piece ring 52 bolted by bolts 54 around extension 46 and fixed onto shoulder 44. The star wheel includes a plurality of outwardly projecting arms 56 supported by posts 60 onto ring 52. A plurality of downwardly projecting pegs 64 extend below poste 60. These downwardly extending pegs 64 at each arm 56 have a plurality of axially spaced adjustable grooves 66, which are adapted to receive a bottle stabilizer ring 70 by way of a mounting housings 72 that are movable axially along posts 64 by retracted spring bias pin 74 in accordance with standard practice. The outward most end of stabilizer ring 70 includes arcuate recesses 76 adapted to engage and stabilize the body 10 of bottle B. In practice, when using the present invention it may be possible to dispense with the use of stabilizer ring 70. A stabilizer structure can be individual members supported on posts 64; however, in the illustrated embodiment the stabilizer ring 70 having a plurality of circumferentially spaced arcuate recesses 76, best shown in FIG. 2. Arms 56 each include an arcuate nesting pocket 80 with an arcuate outer edge and adapted to receive an upper anti-spin insert 82 also having an arcuate edge or end 84. In practice, the upper surface of insert 82 has a plurality of arcuately spaced knife ridges 82*a* referred to as knife stars to engage the lower portion of flange 16 on bottle B. These knife ridges or knife stars are not necessary; however, they may be used with the present invention and are shown in FIG. 2. The upper surface of insert 52 can be otherwise modified or roughened to prevent rotation by frictional engagement with the under surface of flange 16; however, this feature is generally not used with the present invention, since spinning on such modifications will cause scuffing of the plastic forming the under surface of flange 16.

Capping machine A also includes a plurality of capping heads 100 rotated about machine axis x in unison with star wheel 50 by turret 40. Each capping head is located above a pocket 80 of star wheel 50 and includes a collet 102 driven by a standard clutch 104 through a drive unit 106, as shown in FIG. 2. As bottles B move in an arcuate path shown in FIG. 1, the capping head with a cap C in collet 102 is movable downwardly along capping axis y concentric with a bottle or container B held in pocket 80. The cap is then rotated until clutch 104 experiences a proper amount of torque. At that instance, collet 102 is moved upwardly leaving capped bottle B for further movement through machine A. In accordance with standard practice, a fixed guide plate 120 is positioned diametrically opposite pockets 80 of star wheel 50 and includes an arcuately shaped guide surface or edge 122 having a center of curvature corresponding generally with machine axis x. Plate 120 is spaced outwardly from star wheel 50 a distance necessary to allow guide surface or edge 122 to hold bottles B in pockets 80 as they are moved in a circular path by rotation of star wheel 50 by turret 40 and in unison with the matching capping heads 100. To fixedly locate surface or edge 122 of plate 120 in the proper position with respect to the rotating bottles B, support shafts 130 are provided with upwardly extending threaded portions 132. Lock bolts 134, 136 clamp fixed guide plate or back plate 120 with respect to the rotating bottles B in accordance with standard practice. Stabilization of upstanding shafts 130 is provided by a fixed support bar 140 having a more arcuate recess 142 and positioned on the top post 150 supported on base 160 of machine A. Bar 140 has an angular length matching plate 120 and allows shafts 130 to be threaded onto the top of posts 150 spaced radially around machine A in the positions illustrated in FIG. 2. As shown in this Figure, an entrant guide mechanism 170 directs filled bottles B to the capping machine A at an entrant point. In a like manner, exit guide mechanism 172 removes capped bottles B from machine A at an exit point so the bottle move to the exit portion of the bottling line.

In operation, filled bottles B are moved in an assembly line fashion through entrant guide mechanism 70 to capping machine A. The bottles are then engaged by nesting pocket 80 of star wheel 56 and are held in this position by fixed guide plate 120. As turret 40 rotates in the direction indicated by the arrow in FIG. 1 and the arrow in FIG. 2, bottles B move in an arcuate path after the bottle has been captured by machine A. A capping head moving in unison with a pocket 80 and having a cap C in collet 102 starts the capping process by rotating cap C over threaded neck 12 above circular flange 16 of bottle B. As the bottle is restrained from rotational, it is moved by turret 40 around machine A. The capping head finalizes the capping operation and is withdrawn from bottle B before the bottle reaches exit guide mechanism 172. Inserts 82 with recesses 84 actually engage the bottle at the lower surface of flange 16. In the past, the upper surface of these inserts were provided with the knife ridges schematically illustrated as ridges 82a in one of the inserts 82 in FIG. 2. This is for illustrative purposes only since these knife ridges 82*a* are not required in practicing the invention, but they may be a part of the standard machine and need not be removed before adopting the machine with the present invention.

Figure 3:
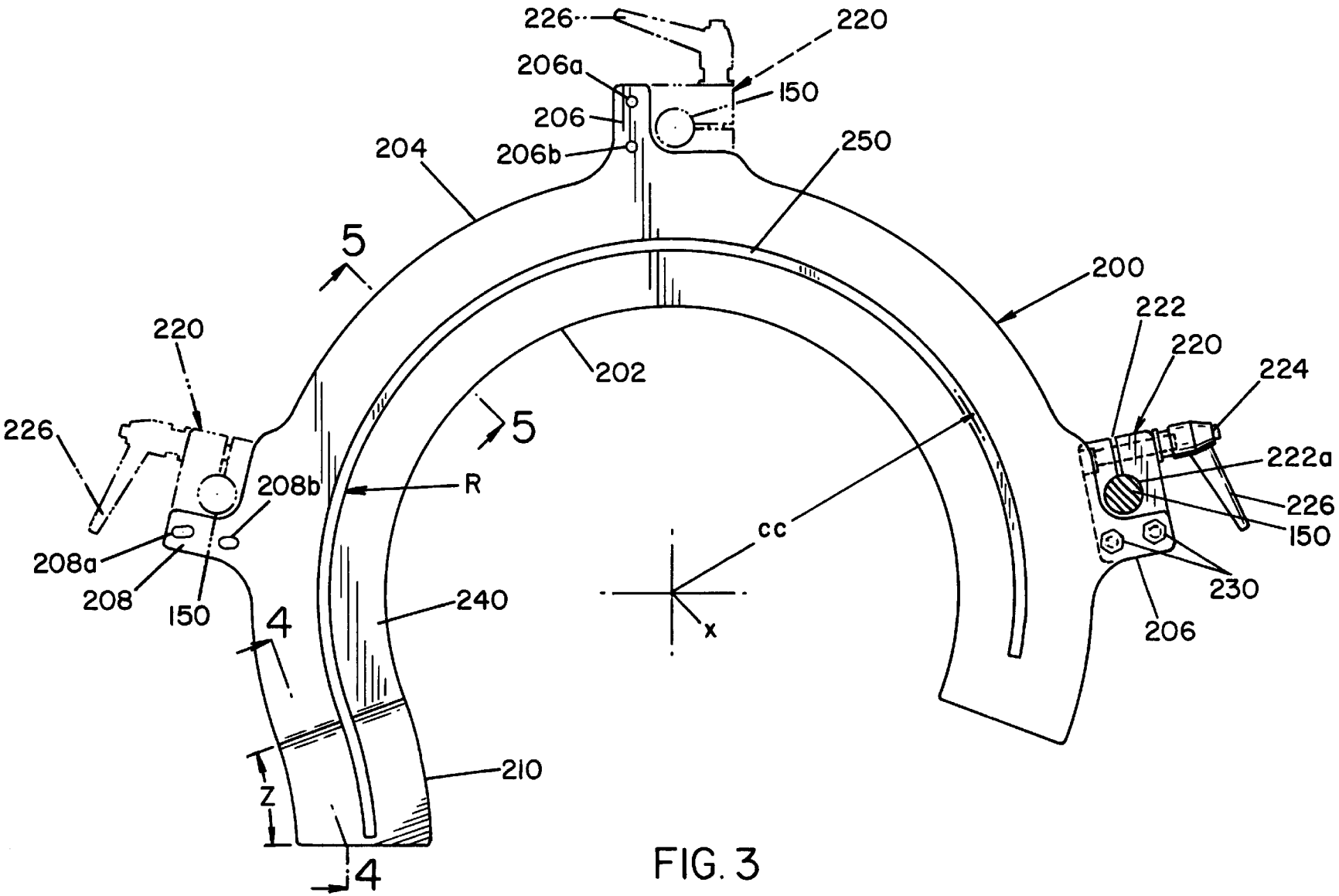
FIG. 3 is a cross sectional view taken generally along line 3—3 of FIG. 2 showing the anti-rotation device constituting the preferred embodiment of the present invention.

In accordance with the invention, capping machine A is provided with an anti-rotation plate 200 in the form of an arcuate metal plate having radially inward edge 202 and radially outward edge 204. As shown in FIG. 3, plate 200 includes outwardly protruding tabs or ears 206 and 208 for fixedly supporting plate 200 below guide plate 120 and directly below axes y of several capping heads 100 to engage the bottom of bottles B as the bottles are capped and moved along the arcuate path determined by rotation of turret 40. Tabs or ears 206 include holes 206*a* and 206*b* for bolts 230. Holes 208*a* and 208*b* in tab 208 are adjustable to accommodate assembly of anti-rotation plate 200 in the proper position on posts 150. Plate 200 includes an entrant end or tongue 210 having a length determined by angle Z, tongue 210 is, in practice, bent slightly downwardly to accommodate bottles riding onto the top of a plate 200 as the bottles are moved from entrant guide mechanism 170 onto capping machine A. To fixedly mount plate 200 in its proper position to engage bases 20 of bottles B, the preferred embodiment includes a plurality of clamps 220 having a slot 222 intersecting bore 222*a* dimensioned to slide over one of the posts 150. Threaded head 224 is rotated by lever 226 to collapse slot 222, thus locking clamp 220 onto post 150 at the desired vertical position below fixed guide plate 120. Bolts 230 assemble clamps 220 onto the lower surface of plate 200 as shown in FIGS. 1 and 2.

Figure 4:
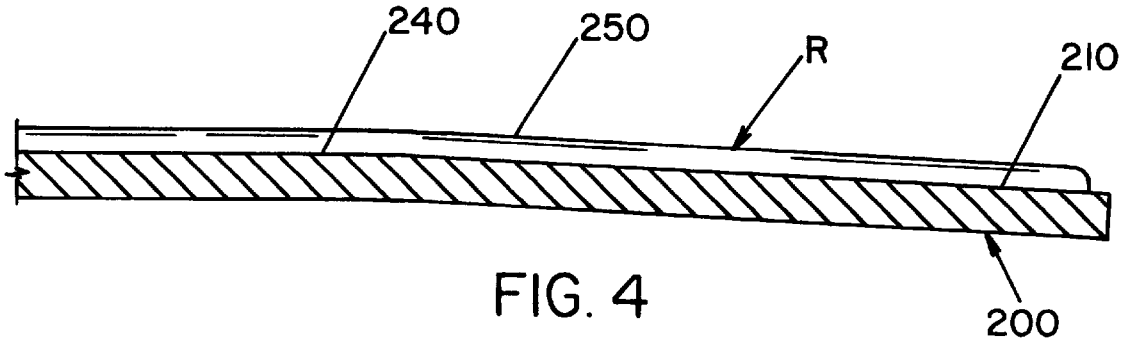
FIG. 4 is an enlarged cross sectional view taken generally along line 4—4 of FIG. 3.
Figure 5:
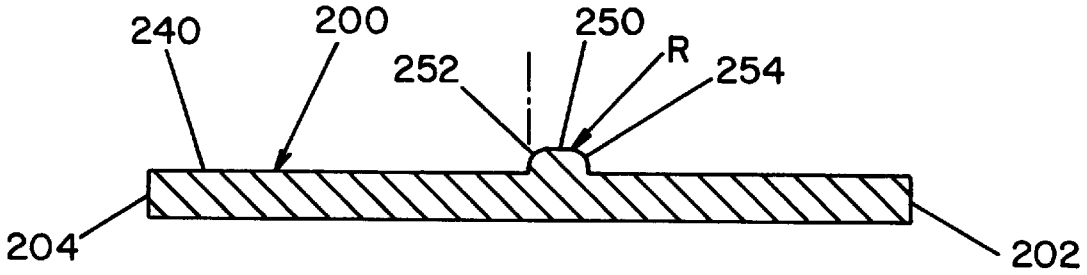
FIG. 5 is an enlarged cross sectional view taken generally along line 5—5 of FIG. 3.
Figure 6:
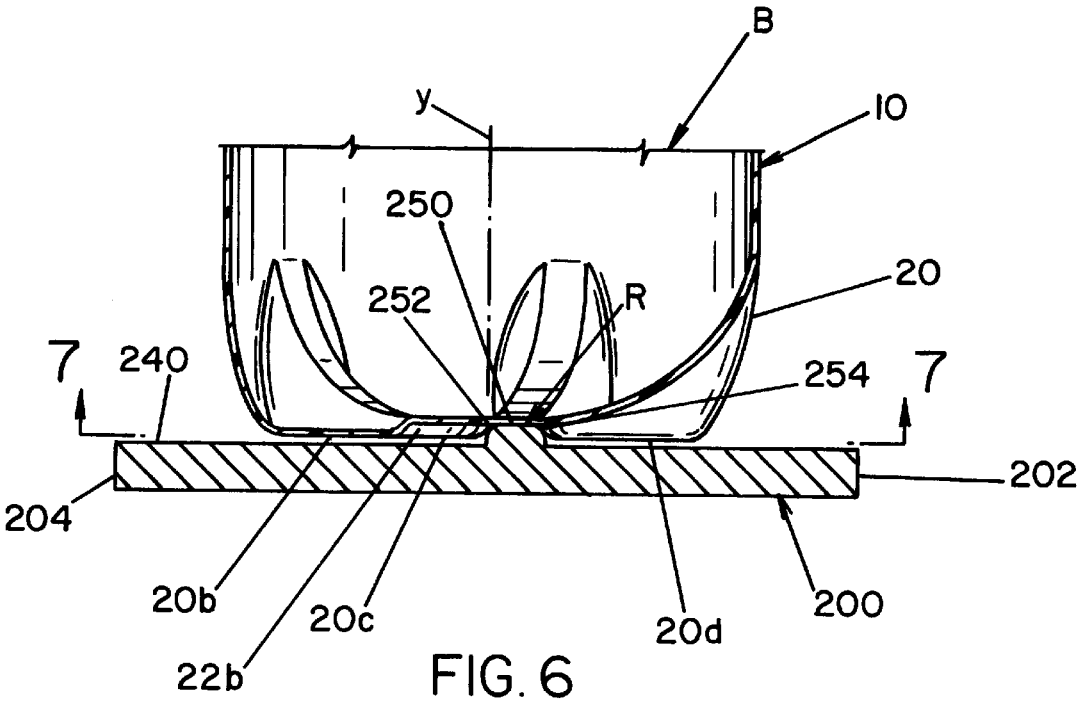
FIG. 6 is an enlarged view of the pedaloid base of a plastic bottle sliding on the anti-rotation device illustrated in FIG. 3.
Figure 7:
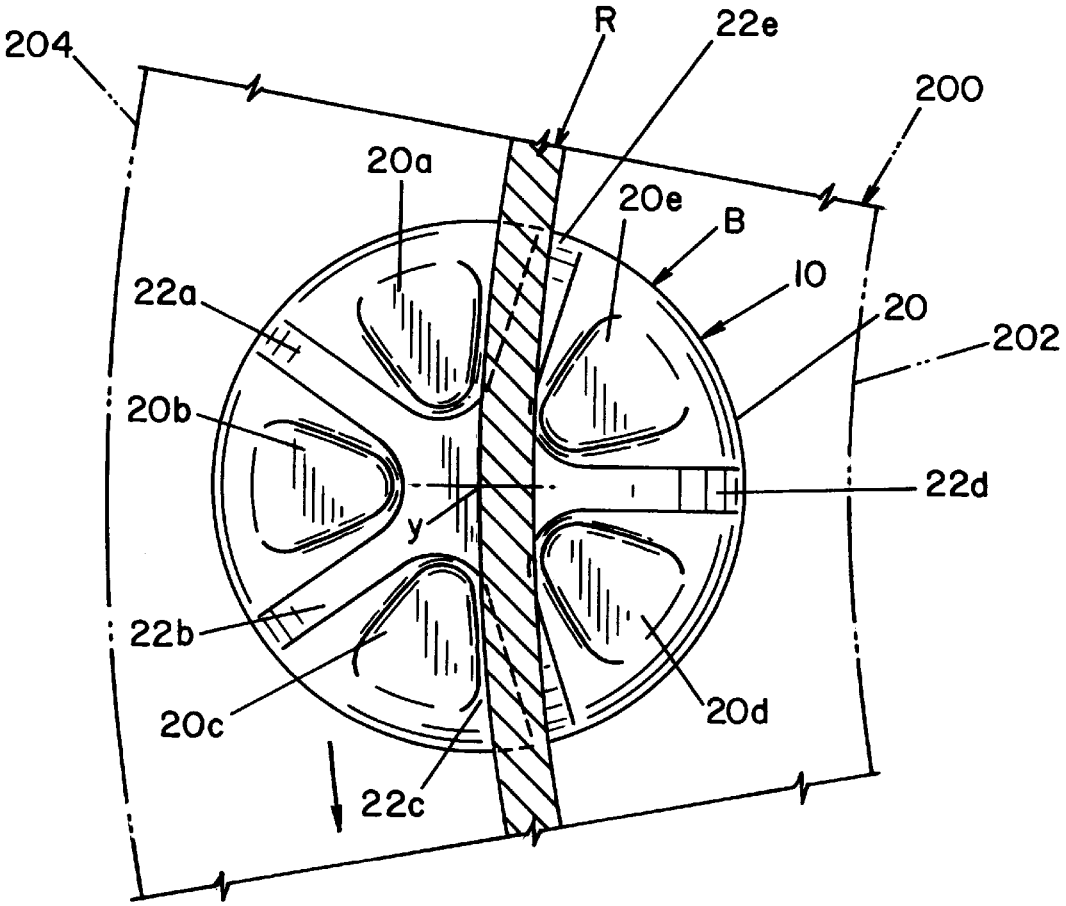
FIG. 7 is a cross sectional view taken generally along line 7—7 of FIG. 6.
Figure 8:
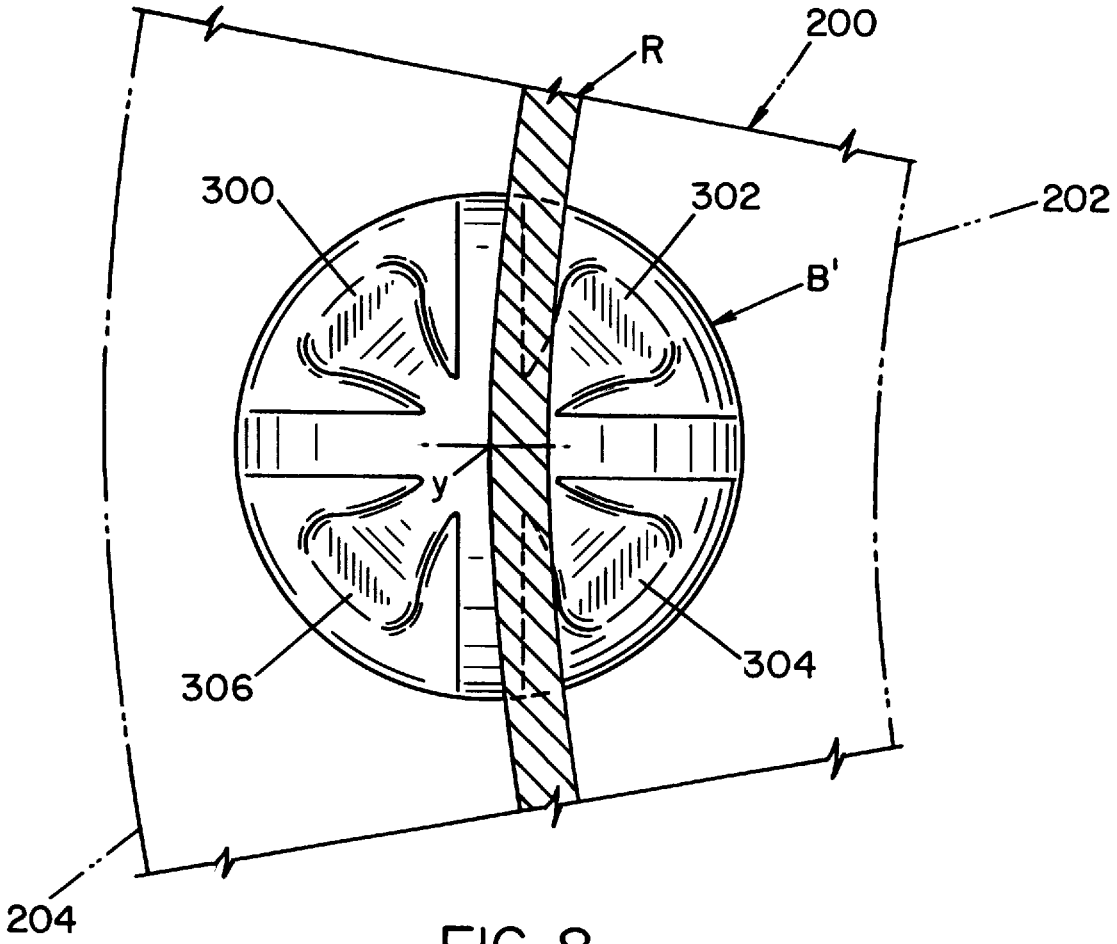
FIG. 8 is a view similar to FIG. 7 illustrating the use of the present invention with a pedaloid base of a plastic bottle wherein the base has four pads instead of five pads which is the more common version; and, FIG. 9 is a view similar to FIG. 5 illustrating a modification of the preferred embodiment of the present invention.

In accordance with the invention, fixed arcuate plate 200 includes an upwardly extending rib R having a center of curvature cc, which is generally concentric with machine axis x, as shown in FIG. 3. Rib R extends upwardly from a flat upper surface 240 of plate 220. As shown in FIGS. 4 and 5, rib R has a generally flat top 250 and curved edges 252, 254. The height of the arcuate rib R in practice is ⅛ inch and the thickness of plate 200 is ¼ inch. The width of rib R is 0.312 inches and the radius of each curved edge of the rib is 0.093 inches. These dimensions are representative and are used in practice for standard bottles having five pads in the lower pedaloid base. The height of rib R should be less than about 0.150 inches if a plate surface is used. However, the invention can be practiced with only a rib and without any supporting surface 240 of plate 200. In this manner, only the rib would engage the bottoms of bottles B. In the illustrated embodiment, the pads are generally spaced above surface 240 as shown in FIG. 6. The invention is essentially the use of a arcuate rib, or a rib matching the path of the moving bottles through a capping machine, which rib extends upwardly into the recesses of a pedaloid base used in a plastic bottle being capped. The action of the rib with respect to base 20 of bottle B is illustrated in FIGS. 6 and 7. As illustrated in FIG. 8, bottle B' has a four pad pedaloid base with pads 300–306. The same rib R can engage the bottom surface of the bottle B' with four pads and bottle B with five pads. An advantage of the present invention is that the rib R can be used with various types of pedaloid bases and various bottles having recessed configurations engagable by the upstanding arcuate rib R. The same rib structure can be used for various bottles. In addition, the rib is stationary and the bottles move or slide along the rib. Consequently, there is no need to synchronize the position and movement of the rib with respect to the rotating action of capping machine A.

Figure 9:
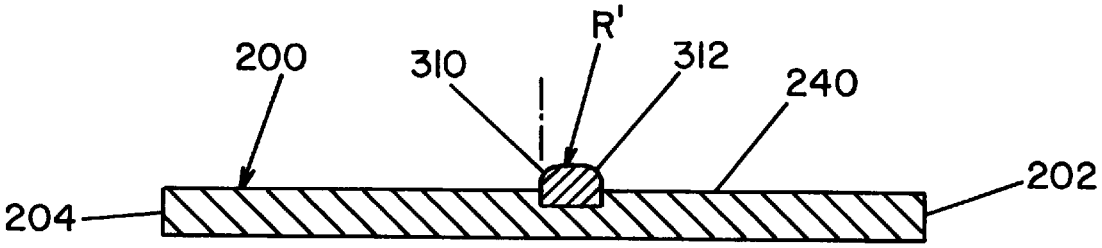

FIG. 5 illustrates the preferred embodiment for forming rib R in plate 200. An end mill removes material from the top of plate 200 to a depth, in practice about ⅛ inches, for defining the upper surface 240 of plate 200. This is done by an end mill which has a radius end matching edges 252, 254. By using a numerical controlled end mill, the arcuate configuration of rib R as shown in FIG. 3 can be easily produced. To blend rib R into the entrant guide mechanism 170 for incoming bottles, a portion of rib R can be contoured, as shown in FIG. 3 at entrant end or tongue 210 of plate 200. Rib R' can be an elongated metal strip 310 mounted in a milled slot 312, as shown in FIG. 9. This is not the preferred embodiment for providing a rib on the top of surface 240 of plate 200. FIG. 9 merely illustrates the possibility of other arrangements for mechanically providing a rib to be used in accordance with the present invention.

Having thus defined the invention, the following is claimed:

1. In a capping machine for applying a threaded cap onto the threaded neck of a plastic container having a generally cylindrical body, a circular flange below said threaded neck and a pedaloid base with pads separated by recesses, said machine including a turret rotatable about a machine axis and carrying a plurality of capping heads, each of which rotate a cap about a capping axis to apply said cap to a neck as said capping head and container move in unison about said machine axis; a capper star wheel rotatable about said machine axis and having a plurality of arcuate nesting pockets engaging said containers immediately below said flanges and lower stabilizers with recesses to engage a container at said body thereof; and, a fixed guide plate with an arcuate guide surface concentric with said machine axis and radially spaced from said star wheel at a position generally diametrically opposite to said nesting pockets of said star wheel whereby containers carried by said star wheel are capped as they are moved along said guide surface of said fixed guide plate, the improvement comprising: a container support member fixedly mounted on said machine below said guide plate, said support member having an upwardly extending arcuate rib with a center of curvature generally corresponding with said machine axis and axially aligned with said capping axes of said capping heads as the capping heads move with said containers and means for supporting said support member with said rib extending into a recess of said pedaloid base of said containers as the container is moved along said rib by said star wheel.

2. The improvement defined in claim 1 wherein said container support member includes an arcuate plate below said fixed guide plate with an upwardly facing, generally flat surface and said rib being located on said upwardly facing surface.

3. The improvement as defined in claim 2 wherein said arcuate plate and said rib are formed from a common piece of metal.

4. The improvement as defined in claim 3 wherein said rib is formed by cutting away portions of said piece of metal.

5. The improvement as defined in claim 1 wherein said rib has a height of less than about 0.150 inches.

6. The improvement as defined in claim 1 wherein said rib has a width of less than 0.400 inches.

7. The improvement as defined in claim 1 wherein said rib has a cross section with curved top edges.

8. The improvement as defined in claim 7 wherein said arcuate plate and said rib are formed from a common piece of metal.

9. The improvement as defined in claim 8 wherein said rib is formed by cutting away portions of said piece of metal.

10. The improvement as defined in claim 1 wherein said supporting means of said support member includes a plurality of support posts used to hold said guide plate in a given vertical position and means for adjustably positioning said support member on said posts at a vertical position where said containers ride along said rib.

11. A method of preventing rotation of a plastic container of the type having a generally cylindrical body, a circular flange below a threaded neck and a pedaloid base with pads separated by recesses as a capping head screws a cap onto said neck while said capping head and container are moving in unison along a preselected path, said method comprising the steps of: providing a support member with an upwardly extending, fixed rib extending along said path and causing said container to rest on said rib as it is moved with said capping head whereby said rib extends into a recess of said pedaloid base to prevent rotation of said container with said capping head.

12. A device for preventing rotation of a plastic container of the type having a generally cylindrical body, a circular flange below a threaded neck and a pedaloid base with pads separated by recesses as a capping head screws a cap onto said neck while said capping head and container are moving in unison along a preselected path, said device comprising: a support member with an upwardly extending fixed rib extending along said path and means for mounting said support member in a position where said container rests on said rib as the container is moved with said capping head whereby said rib extends into a recess of said pedaloid base to prevent rotation of said container with said capping head.

13. A device as defined in claim 12 where said support member includes an arcuate plate below said path of said containers with an upwardly facing generally flat surface and said rib being on said upwardly facing surface.

14. A device as defined in claim 13 wherein said arcuate plate and said rib are formed from a common piece of metal.

15. A device as defined in claim 14 wherein said path is arcuate.

16. A device as defined in claim 13 wherein said path is arcuate.

17. A device as defined in claim 12 wherein said path is arcuate.

18. A device for preventing rotation of a plastic container of the type having a generally cylindrical body, a circular flange below a threaded neck and a pedaloid base with pads separated by recesses as a capping head screws a cap onto said neck while said capping head and container are moving in unison along a preselected path, said device comprising: a plate with an upwardly facing support surface with a rib extending upwardly from said surface and matching said preselected path and means for fixedly positioning said plate below said containers with said rib engaging a recess of the pedaloid base of said containers as the containers move along said path.

19. A method of preventing rotation of a plastic container of the type having a generally cylindrical body, a circular flange below a threaded neck and a base with recesses as a capping head screws a cap onto said neck while said capping head and container are moving in a preselected path, said method comprising the steps of: providing a support member with an upwardly extending fixed rib extending along said path and into one of said recesses in the base of said container as said container is moved in unison with said capping heads whereby said rib extends into one of said recesses of said base to prevent rotation of said container with said capping head.

20. A device for preventing rotation of a plastic container of the type having a generally cylindrical body, a circular flange below a threaded neck and a base with recesses as a capping head screws a cap onto said neck while said capping head and container are moving in a preselected path, said device comprising: a support member with an upwardly extending fixed rib extending along said path and means for mounting said support member in a position where said container rests on said rib as the container is moved with said capping head whereby said rib extends into a recess of said base to prevent rotation of said container with said head.

21. A method of preventing rotation of a bottle of the type having a generally cylindrical body, a threaded neck and a downwardly facing base with a recess as a capping head screws a cap onto said neck while said capping head and container are moving in unison along a preselected path, said method comprising the steps of: providing a support member with an upwardly extending fixed rib extending along said path and extending into said recess of said base to prevent rotation of said container as said container moves along said rib.

22. A device for preventing rotation of a plastic container of the type having a generally cylindrical body, a threaded neck and a downwardly facing base with a recess as a capping head screws a cap onto said neck while said capping head and container are moving in unison along a preselected path, said device comprising: a support member with an upwardly extending fixed rib extending along said path and extending into said recess of said base to prevent rotation of said container as said container moves along said rib.

* * * * *